US007909663B1

(12) United States Patent
Bouffet

(10) Patent No.: US 7,909,663 B1
(45) Date of Patent: Mar. 22, 2011

(54) MODULAR OPTIMIZED PLUG-IN JAW

(76) Inventor: Olivier Bouffet, Brentwood, TN (US)

( * ) Notice: Subject to any disclaimer, the term of this patent is extended or adjusted under 35 U.S.C. 154(b) by 0 days.

(21) Appl. No.: 12/633,537

(22) Filed: Dec. 8, 2009

(51) Int. Cl.
*H01R 11/09* (2006.01)

(52) U.S. Cl. ..... 439/787; 439/212

(58) Field of Classification Search ..... 439/212, 439/845, 717, 787, 857
See application file for complete search history.

(56) References Cited

U.S. PATENT DOCUMENTS

| | | | | |
|---|---|---|---|---|
| 3,201,556 | A * | 8/1965 | Baird | 439/251 |
| 5,013,265 | A * | 5/1991 | Buchter et al. | 439/724 |
| 6,508,656 | B2 * | 1/2003 | Chevassus-More et al. | 439/212 |
| 7,090,544 | B2 | 8/2006 | Campbell et al. | 439/810 |
| 7,581,972 | B2 * | 9/2009 | Daamen | 439/249 |

* cited by examiner

*Primary Examiner* — Khiem Nguyen

(57) ABSTRACT

A modular jaw unit for a busway system includes a spring support member having a central section and four independently moving support ends. The central section has a plurality of bosses and slots for coupling the jaw unit to another jaw unit. The support ends extend from the central section and are independently movable with respect to each other. A pair of wires are positioned within the support member, and each of the wires has wire ends located adjacent to a respective support end of the support member.

23 Claims, 5 Drawing Sheets

MODULAR OPTIMIZED PLUG-IN JAW

FIELD OF THE INVENTION

This invention is directed generally to a electrical systems, and, more particularly, to a modular connector jaw for plug-in unit used in a busway system.

BACKGROUND OF THE INVENTION

Busway electrical distribution systems are well known in the art of electrical distribution. Busway systems are comprised of a number of factory assembled sections each including a number of individually insulated generally flat electrical conductors or busbars stacked one upon another and enclosed within a housing which provides protection and support for the busbars. For example, typical busway systems have 10-foot sections of flat, stacked, electrical conductors for transporting electrical energy from a point A to a point B, while distributing the electrical energy to various electrical loads. Busway construction is modular and, in many ways, is superior to cable and conduit systems from an installation standpoint.

For distribution of the electrical energy, the busway sections include one or more plug-in outlets having a plurality of conductive stabs. In general, the plug-in outlets include openings that are provided through the housing of the busway system at each of a plurality of power tap-off sections to expose conductive material of the busbars for connection with an appropriate connecting jaw. A plug-in unit, which is used to tap off power from the busway, is attached to a base in the plug-in opening by mounting a plurality of jaws to a corresponding stab, which extends from a respective busbar.

Present busway systems, however, fail to provide an efficient, cost-effective, and simple solution for installing plug-in units having different electrical load requirements (i.e., different ampacities). To install plug-in units of different ampacities, present busway systems must use different jaws, based on the respective load requirement. For example, the same jaw may be used for a load requirement of 30 Amperes, 60 Amperes, and 100 Amperes, but a different jaw must be used for a load requirement of 250 Amperes and 400 Amperes. Thus, one problem associated with the need for different jaws is that it increases manufacturing costs, wherein different jaws require different manufacturing tooling. Another problem associated with present jaws is that they typically provide a single line of contact per each side of the corresponding stab, wherein the line of contact may result in a single contact point based on alignment problems. These problems may be present in various electrical products, such as switchboards, panelboards, loadcenters, switchgears, circuit breakers, and others.

What is needed, therefore, is a jaw module for a plug-in unit of a busway system that addresses the above-stated and other problems.

SUMMARY OF THE INVENTION

In an implementation of the present invention, a modular jaw unit for a busway system includes a spring support member having a central section. The central section has a plurality of coupling bosses and a plurality of coupling slots. The coupling bosses are positioned on one side of the support member for inserting into respective coupling slots of another modular jaw unit. The coupling slots are positioned on an opposite side of the support member for receiving respective coupling bosses of the another modular jaw unit. Four independently moving support ends include two support ends extending from the central section in one direction and two support ends extending from the central section in an opposite direction. A pair of wires include a first wire and a second wire positioned within the support member. Each of the wires has two oppositely located wire ends such that each of the wire ends is adjacent to a respective one of the support ends of the support member.

In an alternative implementation of the present invention, a busway system includes a busbar assembly having a plurality of busbars for transporting and distributing electrical current to an electrical device. The busbar assembly has at least one plug-in opening through which at least one stab extends from one of the busbars. A plug-in unit provides a housing for the electrical device, e.g., a circuit breaker, and is mounted to the plug-in opening. A modular jaw is coupled to the plug-in unit for connecting a connector of the electrical device to the stab. The modular jaw has at least one modular unit that is capable of connecting to another modular unit such that the size of the modular jaw is changeable to accommodate different ampacity requirements.

In another alternative implementation of the present invention, a busway system includes a busbar assembly for distributing electrical current to an electrical device. The busbar assembly includes a busbar housing having at least one plug-in opening; a plurality of stacked busbars enclosed at least in part in the busbar housing; and at least one electrically conductive stab extending from a corresponding busbar through the plug-in opening. A plug-in unit is mounted to the plug-in opening, the plug-in unit enclosing at least in part the electrical device and the electrical device having an electrical connector for receiving electrical current. The busway system includes at least one electrically conducting modular jaw capable of having a plurality of modular units removably connected and identical to each other, the modular jaw having a first jaw end connected to the stab and a second jaw end connected to the electrical connector. Each of the modular units includes a spring support member having four independently moving support ends, two of the support ends being located at the first jaw end and two of the support ends being located at the second jaw end. The modular units further include a pair of wires that are placed at least in part within the spring support member, each of the wires having two oppositely located wire sections. The symmetry of the wires eliminates cost and enhances ease of assembly by eliminating, for example, the need for manufacturing and assembling two differently shaped wires. The modular units further include a closing member for securing the wires in the support member. At the first jaw end, the corresponding support ends force respective ones of the wire sections in contact with the stab, while at the second jaw end the corresponding support ends force respective ones of the wire sections in contact with the connector.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
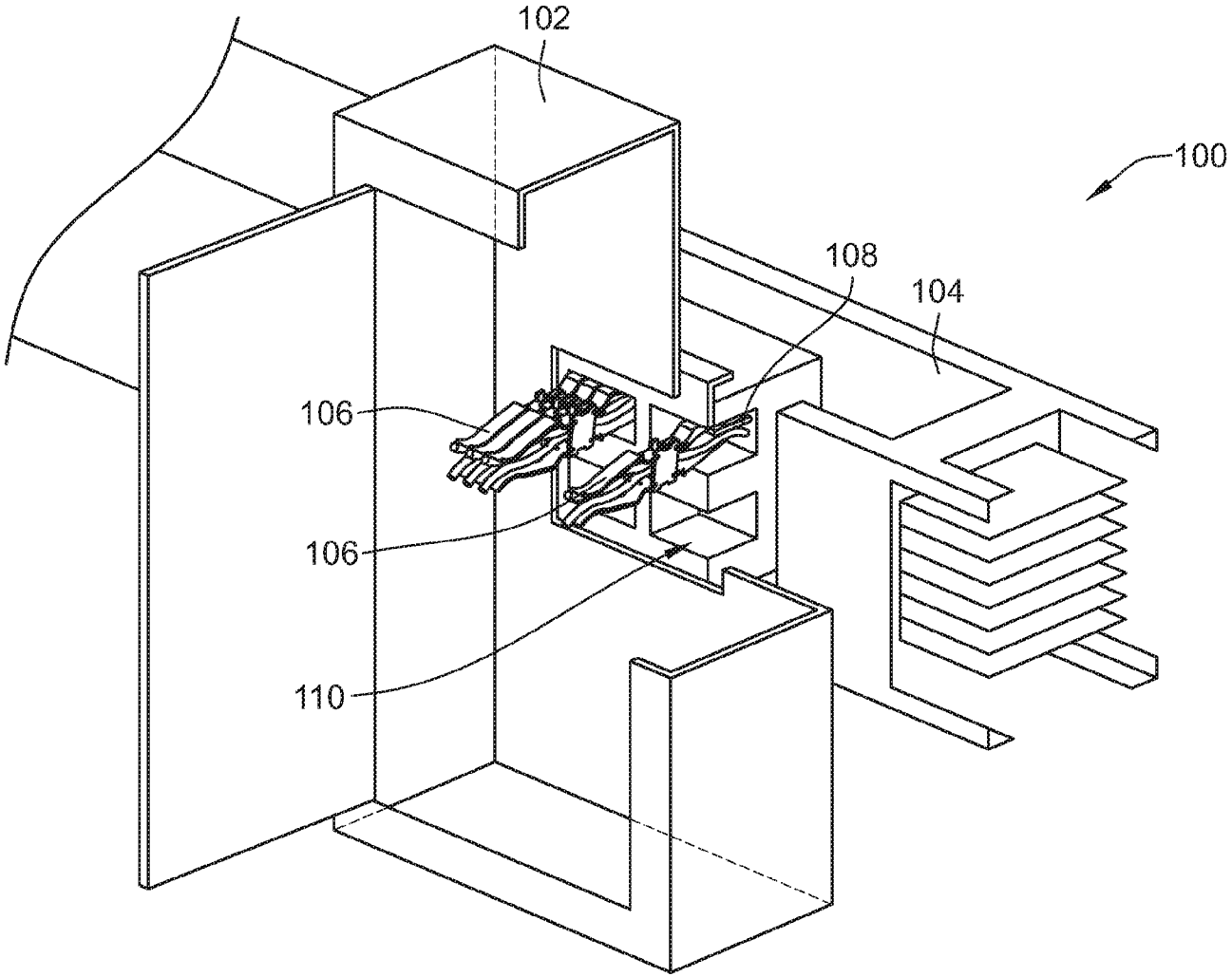
FIG. 1 is a perspective view of a busway system having a busbar assembly and plug-in unit with modular jaws.
Figure 2A:
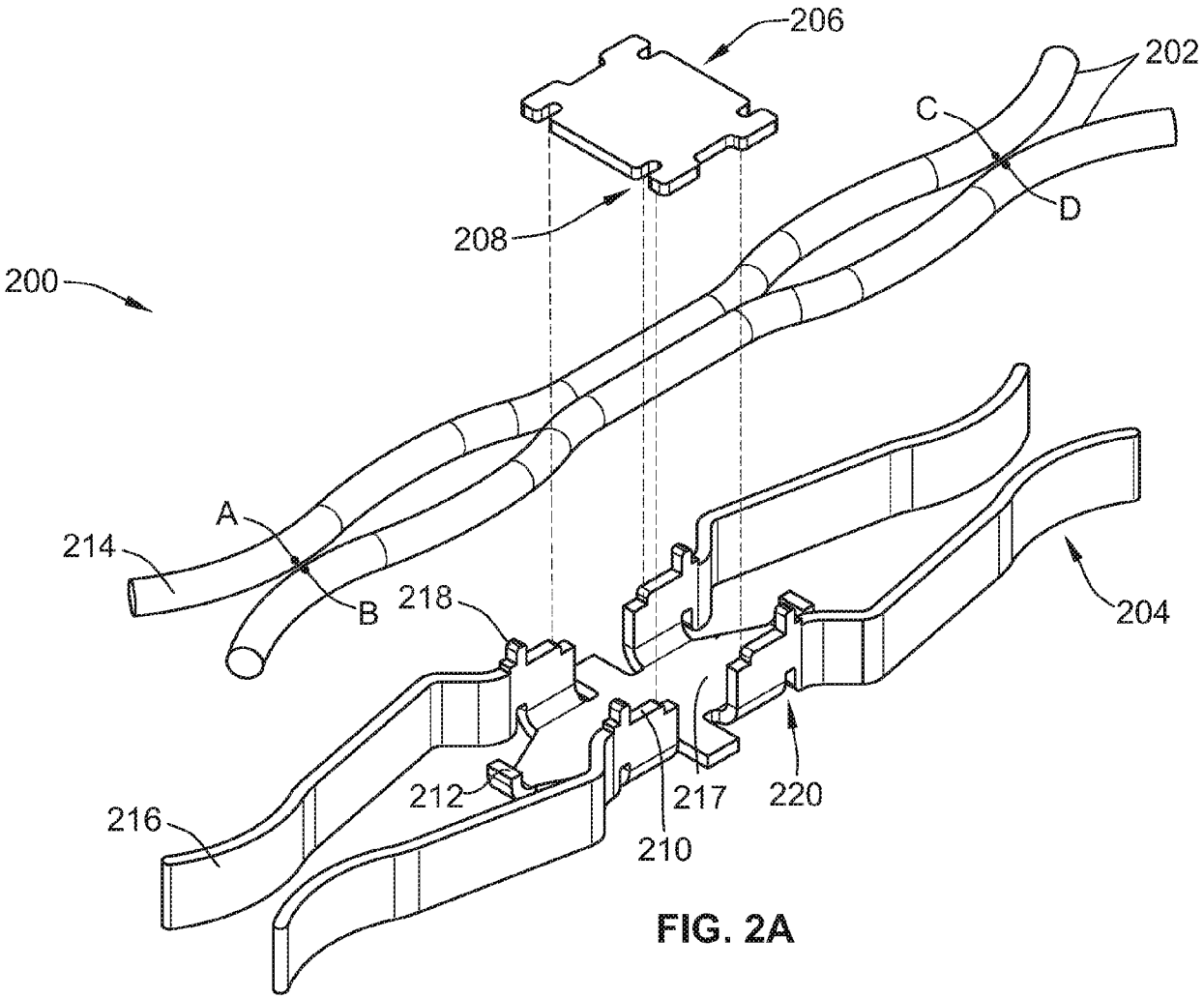
FIG. 2A is an exploded perspective view of a single modular jaw unit.
Figure 2B:
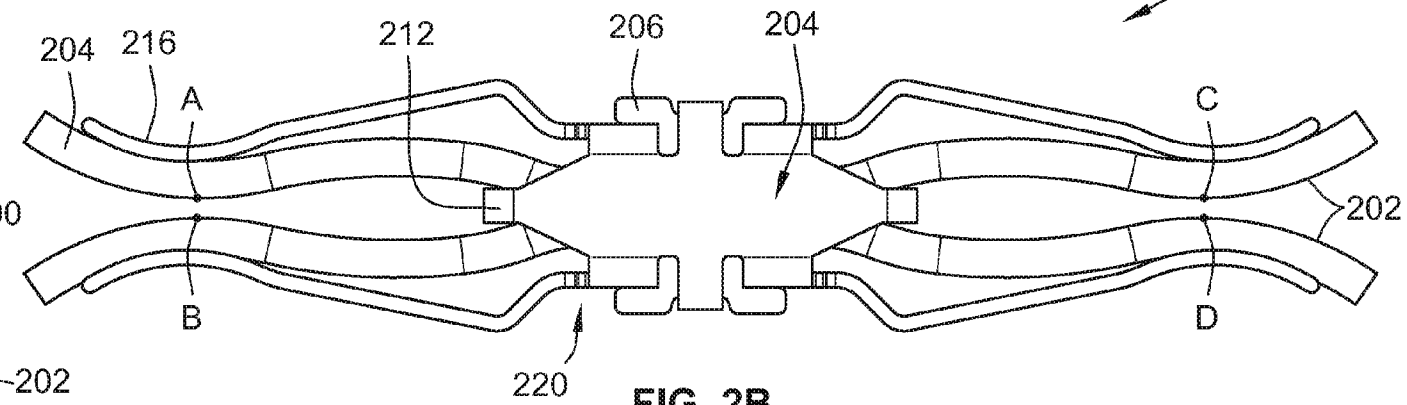
FIG. 2B is an assembled top view of the jaw unit of FIG. 2A.
Figure 2C:
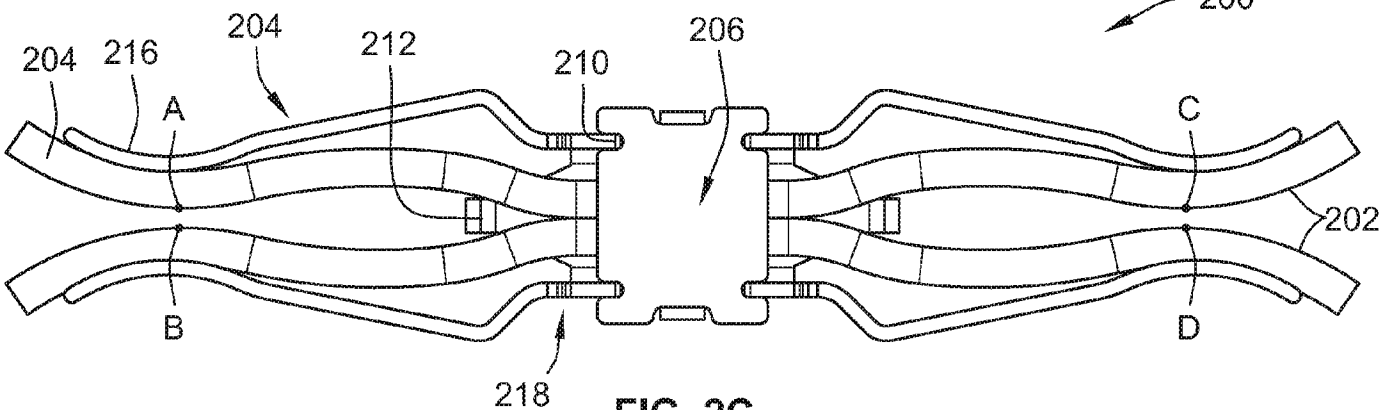
FIG. 2C is an assembled bottom view of the jaw unit of FIG. 2A.
Figure 2D:
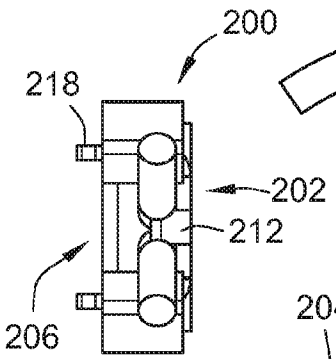
FIG. 2D is an assembled side view of the jaw unit of FIG. 2A.

Referring to FIG. 1, a busway system 100 has a plug-in unit 102 that is mounted to a section of a busbar assembly 104. The plug-in unit 102 typically houses a circuit breaker or fusible disconnect means. Other electrical devices that can be housed in the plug-in unit 102 for connecting to the busbar assembly 104 include, for example, switchboards, solar panels, safety switches, panelboards, loadcenters, and switchgears. The connection of the plug-in unit 102 to the busbar assembly 104 is made by electrical jaws 106 engaging corresponding stabs 108 of the busbar assembly 104, which extend through a plug-in opening 110 of the busbar assembly 104. On one end, the electrical jaws 106 engage the corresponding stabs 108, and on another end, the electrical jaws 106 engage a corresponding connector of the electrical device being connected (e.g., an electrical connector of a circuit breaker). Each of the electrical jaws 106 can have one or more modular jaw units.

Referring to FIGS. 2A-2D, a single modular jaw unit 200 has two copper wires 202 that are housed and supported by a stainless steel spring member 204. The wires 202 have a wire section 214 that is located at each wire end and that is shaped to capture or connect an electrical connector. According to one example, the wires 202 have a diameter of approximately 0.080 inches. However, the diameter of the wires 202 can be larger or smaller based on optimization variables, such as performance, heat rise, etc.

A closing member in the form of a closing plate 206 locks the wires 202 in place to form a single jaw unit 200. According to the illustrated embodiment, the closing plate 206 is connected to the spring member 204 by snapping the two together, wherein slots 208 of the closing plate 206 are snapped in place, respectively, over shoulders 210 of the spring member 204. Alternatively, the spring member 204 is formed and folded over on itself to serve the same closing function as the closing plate 206. In other words, instead of using the closing plate 206 as a separate member, the closing member is generally similar to the closing plate 206 but is formed integrally with the spring member 204 to lock the wires 202 in place for forming a single jaw unit 200. In other embodiments, any components of the jaw unit 200 can be connected together by any other connecting methods, such as by using bolts, rivets, adhesives, screws, etc.

When assembled, the wires 202 are fixed in position by a pair of locating bosses 212, which are positioned generally symmetrical to each other. Each wire section 214 of the wires 202 is in contact with a corresponding support end 216 of the spring member 204. The support ends 216 extend from a central section 217 of the spring member 204.

The support ends 216 are independently movable and are formed to have an inward rounded shape such that, upon contact with the wire sections 214, they force the respective wire section 214 in contact with an electrical connector of the plug-in unit 102 or the stab 108. As such, the jaw unit 200 is spring loaded on both ends, to provide good contact points and help minimize contact resistance in the current path at each contact point.

The jaw unit 200 provides a total of 4 electrical contact points A-D for each single jaw unit 200. Two contact points, such as contact points A and B, are provided at one coupling end of the jaw unit 200 for connection with the stab 108, and two contact points, such as contact points C and D, are provided at another coupling end of the jaw unit 200 for connection to an electrical module coupled to the plug-in unit 102 (e.g., a circuit breaker). The jaw unit 200 is removably connectable to the stab 108 and to the electrical module. Based on the removable connection (e.g., in contrast to a permanent connection in which a connecting jaw is integrated with a plug-in unit), an advantage of the jaw unit 200 is that a user can disconnect electrical components upstream of the jaw unit 200 to isolate electrical components downstream of the jaw unit 200 (such as for safe maintenance operations), without having to unplug the plug-in unit from the busbar assembly 104.

The spring member 204 further has a plurality of coupling bosses 218 extending from an end point of a corresponding shoulder 210. The coupling bosses 218 are provided for mounting the jaw unit 200 to another jaw unit 200. Opposite to the coupling bosses 218, the spring member 204 has a plurality of coupling slots 220 for receiving corresponding coupling bosses 218 of another jaw unit 200. The mounting of the jaw unit 200 in a multi-unit jaw is described in more detail below.

The jaw unit 200 can be manufactured and assembled entirely using an automated assembly process. For example, an exemplary fully automated machine is a Bihler machine for stamping and bending sheet metal into the described components of the multi-jaw unit. The Bihler machine is manufactured by Otto Bihler Maschinenfabrik and is optionally available with an integrated PLM Software package from Siemens. The Bihler machine can stamp, bend, and cap sheet metal to form the jaw unit 200, and, can assemble multiple jaw units 200 into a single multi-unit jaw. The fully automated manufacturing and assembly process is advantageous because it reduces cost, while producing a high volume of units.

Figures 3A, 3B:
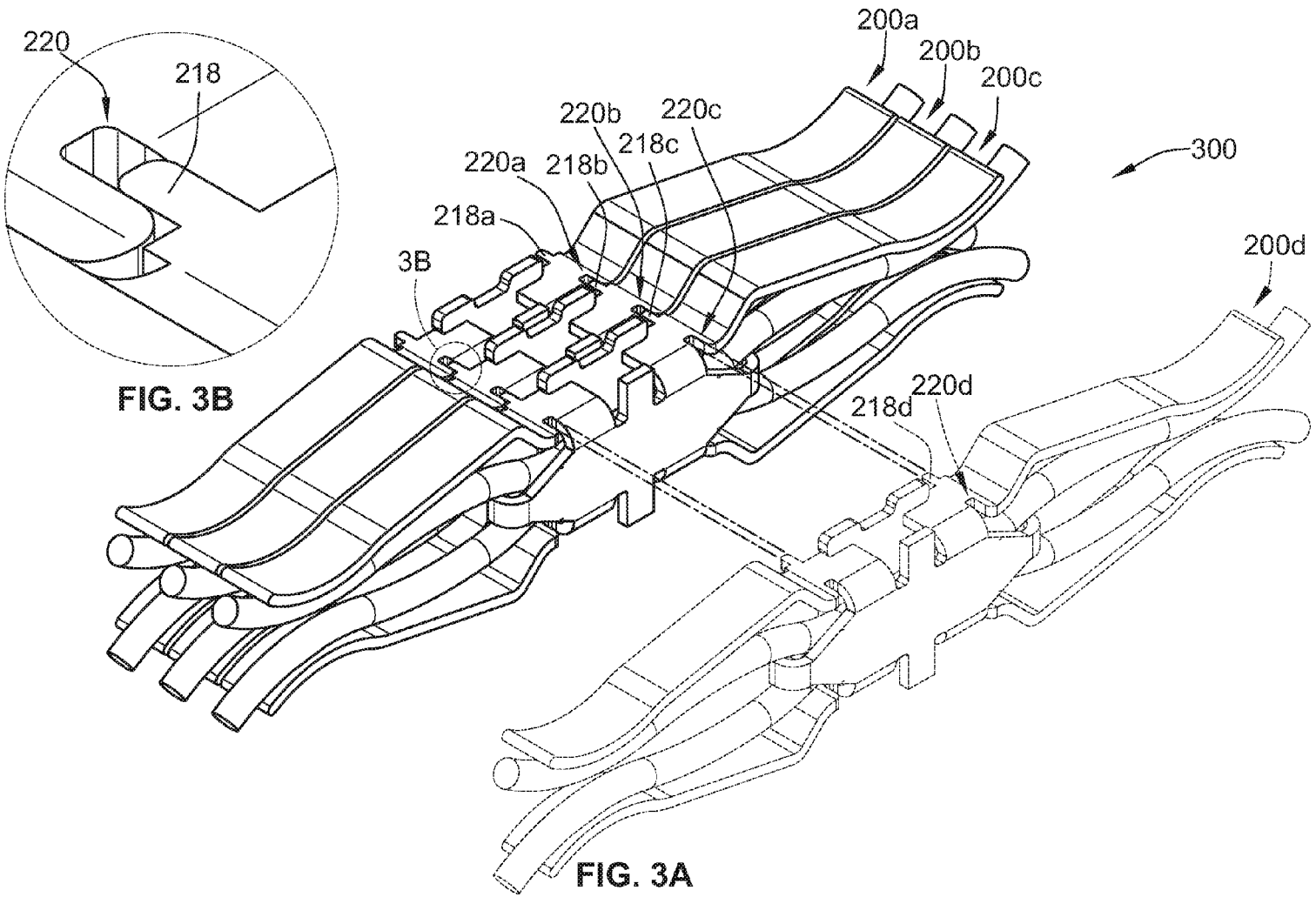
FIG. 3A is a perspective view illustrating modular stacking of a single modular jaw unit to a three-jaw modular unit.
FIG. 3B is an enlarged view illustrating a snap connection between two adjacent jaw units.

Referring to FIGS. 3A and 3B, a multi-unit jaw 300 includes four single jaw units 200*a*-200*d*, with a fourth jaw unit 200*d* being illustrated in the process of being mounted. The single jaw units 200*a*-200*d* are mounted to each other by snapping coupling bosses 218 into corresponding coupling slots 220.

For example, the coupling bosses 218*b* of a second jaw unit 200*b* are inserted (e.g., by snapping) into the coupling slots 220*a* of a first jaw unit 200*a*; the coupling bosses 218*c* of a third jaw unit 200*c* are inserted into the coupling slots 220*b* of the second jaw unit 200*b*; and the coupling bosses 218*d* of the fourth jaw unit 200*d* are inserted into the coupling slots 220*c* of the third jaw unit 200*c*. The coupling bosses 218*a* of the first jaw unit 200*a* remain free at one end of the multi-unit jaw

300, and the coupling slots 220*d* of the fourth jaw unit 200*d* remain open at the other end of the multi-unit jaw 300.

According to other embodiments, other methods of connecting single jaw units into a multi-unit jaw can be used. For example, instead of a snapping method, the single jaw units can be connected to each other by riveting or bolting methods. In another example, a plug-in unit may also be equipped to accommodate support/shrouding features to facilitate the efficacious use of jaw units.

Figure 4B:
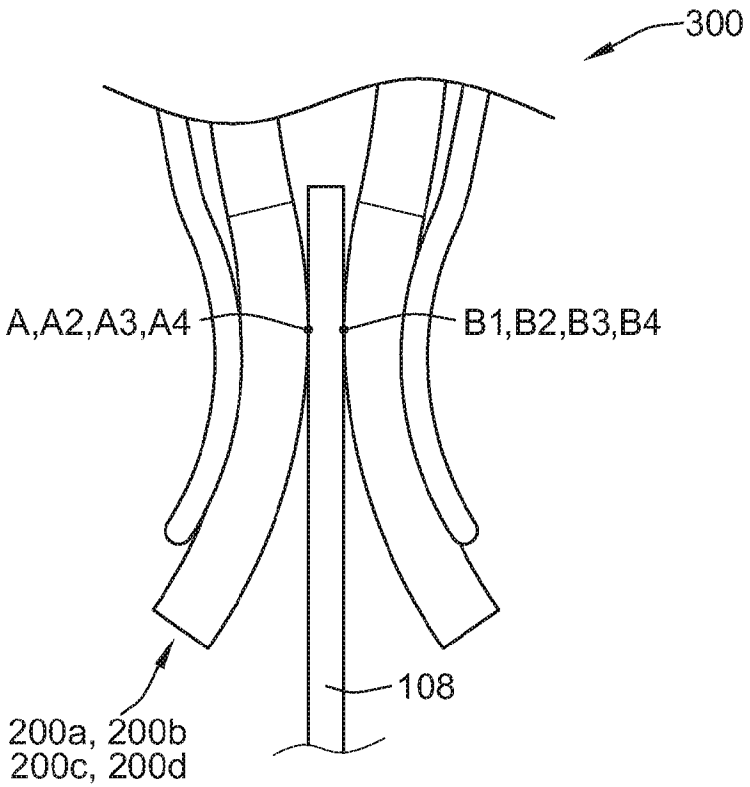
FIG. 4B is a side view of FIG. 4A.
Figure 4A:
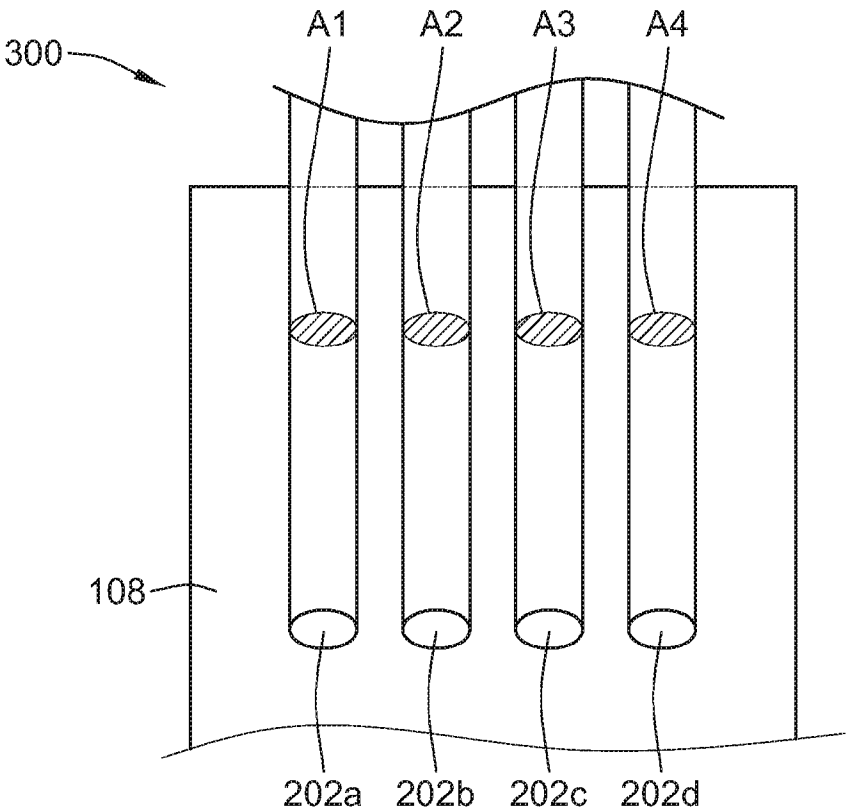
FIG. 4A is a top view illustrating mounting of different jaw units to corresponding stabs of a busway system.

Referring to FIGS. 4A and 4B, the multi-unit jaw 300 is illustrated connected to the corresponding stab 108. The multi-unit jaw 300 provides a total of 8 contact points A1-A4 and B1-B4 with the stab 108. Specifically, 4 contact points A1-A4 are provided on one side of the multi-unit jaw 300, and are formed by contact between the four wires 202*a*-202*d* of the single jaw units 200*a*-200*d* and the stab 108. The remaining 4 contact points B1-B4 are similarly provided and formed on an opposing side of the multi-unit jaw 300.

The number of units of the multi-unit jaw 300 can vary based on electrical requirements. For example, a single multi-unit jaw 300 can be effectively used for an electrical load range from 30 Amperes to 800 Amperes, wherein the ampacity requirements are met by adding (or removing, as necessary) units from the multi-unit jaw 300.

In accordance with this embodiment, the 8 contact points A1-A4 and B1-B4 are advantageous over current jaw connections in which only two contact points may be provided based on misalignment of the jaw with respect to the stab. The advantages of having an increased number of points includes improving the current path from the jaw to the bus bar, therefore reducing the electrical resistance at the interface. In turn, the improved current path improves local thermal performance.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A modular jaw unit for a busway system, the modular jaw unit comprising:

a spring support member having a central section having a plurality of coupling bosses and a plurality of coupling slots, the coupling bosses being positioned on one side of the support member for inserting into respective coupling slots of another modular jaw unit, the coupling slots being positioned on an opposite side of the support member for receiving respective coupling bosses of the another modular jaw unit, and four independently moving support ends, two of the support ends extending from the central section in one direction and two of the support ends extending from the central section in an opposite direction; and a pair of wires including a first wire and a second wire positioned within the support member, each of the wires having two oppositely located wire ends such that each of the wire ends is adjacent to a respective one of the support ends of the support member.

2. The modular jaw unit of claim 1, wherein each of the wire ends is in contact with the respective one of the support ends.

3. The modular jaw unit of claim 1, further comprising a closing member for securing the wires within the support member, the closing member being in the form of a plate having a number of slots, each of the slots receiving a respective shoulder of the central section of the support member.

4. The modular jaw unit of claim 3, wherein the closing member is a separate plate.

5. The modular jaw unit of claim 3, wherein the closing member is integral with the support member.

6. The modular jaw unit of claim 1, wherein the support member further includes a pair of locating bosses located between the two wires.

7. The modular jaw unit of claim 1, wherein the support member further includes a plurality of coupling bosses and a plurality of coupling slots, the coupling bosses being on a first side of the support member and the coupling slots being on a second side of the spring member, the first side being opposite to the second side.

8. The modular jaw unit of claim 7, wherein the coupling bosses are integrally formed on the first side and are connectable to respective coupling slots of a second support member, the second support member being a component of a second modular jaw unit.

9. The modular jaw unit of claim 7, wherein the coupling slots are integrally formed on the second side and are connectable to respective coupling bosses of a second support member, the second support member being a component of a second modular jaw unit.

10. The modular jaw unit of claim 1, wherein each of the support ends are shaped to force an adjacent one of the wire ends toward a contact point with a stab of a busway or a connector of a plug-in unit.

11. The modular jaw unit of claim 1, wherein two of the support ends and their respective wire ends form a first coupling end of the modular jaw unit, two other ones of the support ends and their respective wire ends form a second coupling end of the modular jaw unit, the first coupling end being removably connectable to a stab of a busway and the second coupling end being removably connectable to a connector of a plug-in unit.

12. A busway system comprising:

a busbar assembly having a plurality of busbars for transporting and distributing electrical current to an electrical device, the busbar assembly having at least one plug-in opening through which at least one stab extends from one of the busbars;

a plug-in unit mounted to the plug-in opening of the busbar assembly, the plug-in unit housing the electrical device; and a modular jaw coupled to the plug-in unit, the modular jaw connecting a connector of the electrical device to the stab for receiving electrical current, the modular jaw having at least one modular unit that is capable of connecting to another modular unit such that the size of the modular jaw is changeable to accommodate different ampacity requirements.

13. The busway system of claim 12, wherein the modular jaw includes at least two modular units.

14. The busway system of claim 12, wherein the modular unit is identical to the another modular unit.

15. The busway system of claim 12, wherein the modular unit has a spring support member, the support member having a plurality of independently flexible members extending from a central portion of the support member, each of the flexible members being shaped to force a corresponding wire section in contact with the connector.

16. The busway system of claim 12, wherein each modular unit of the modular jaw has four electrical contact points, a first pair of the contact points being located at one end of the modular unit and having the contact points opposite to each other, a second pair of the contact points being located at another end of the modular unit and having the contact points opposite to each other, the first pair of the contact points being in direct contact with the stab and the second pair of the contact points being in direct contact with the connector.

17. The busway system of claim 16, wherein the modular jaw has at least four electrical contact points in direct contact with the stab, two of the four electrical contact points being on a first side of the stab and two other ones of the four electrical contact points being on a second side of the stab, the first side and the second side being opposite surfaces of the stab.

18. The busway system of claim 12, wherein the modular unit is connected to the another modular unit by snapping a plurality of coupling bosses into respective coupling slots.

19. The busway system of claim 18, wherein the coupling bosses and the coupling slots are integrally formed with a spring member of each of the modular unit and the another modular unit, the coupling bosses being formed on a first side of the spring member and the coupling slots being formed on a second side of the spring member, the first side being opposite to the second side.

20. The busway system of claim 12, wherein the modular jaw accommodates an ampacity range of 30 Amperes to 800 Amperes.

21. A busway system comprising:

a busbar assembly for distributing electrical current to an electrical device, the busbar assembly including a busbar housing having at least one plug-in opening, a plurality of stacked busbars enclosed at least in part in the busbar housing, and at least one electrically conductive stab extending from a corresponding busbar through the plug-in opening;

a plug-in unit mounted to the plug-in opening, the plug-in unit enclosing at least in part the electrical device, the electrical device having an electrical connector for receiving electrical current; and at least one electrical modular jaw having a plurality of modular units removably connected and identical to each other, the modular jaw having a first jaw end connected to the stab and a second jaw end connected to the connector, each of the modular units including a spring support member having four independently moving support ends, two of the support ends being located at the first jaw end and two of the support ends being located at the second jaw end, a pair of wires placed at least in part within the support member, each of the wires having two oppositely located wire sections, and a closing member for securing the wires in the support member, wherein at the first jaw end the corresponding support ends force respective ones of the wire sections in contact with the stab, at the second jaw end the corresponding support ends force respective ones of the wire sections in contact with the connector.

22. The busway system of claim 21, wherein the modular jaw has at least four electrical contact points at the first jaw end and at least four electrical contact points at the second jaw end.

23. The busway system of claim 21, wherein each of the modular units includes a plurality of coupling bosses and coupling slots, a first one of the modular units being coupled directly to a second one of the modular units by inserting coupling bosses of the first one of the modular units into coupling slots of the second one of the modular units.

* * * * *